United States Patent [19]

Johnson

[11] 4,357,929

[45] Nov. 9, 1982

[54] SPACE HEATING APPARATUS

[75] Inventor: Edward Johnson, Furlong, Pa.

[73] Assignee: Kero-Sun, Inc., Kent, Conn.

[21] Appl. No.: 184,356

[22] Filed: Sep. 5, 1980

[51] Int. Cl.[3] ..... F24C 5/04; F23D 13/04

[52] U.S. Cl. ..... 126/96; 431/320; 431/344

[58] Field of Search ..... 126/96, 97; 431/302, 431/304, 310, 196, 201, 320, 344, 260, 261

[56] References Cited

U.S. PATENT DOCUMENTS

| | | | |
|---|---|---|---|
| 1,694,604 | 12/1928 | Ryan | 126/96 |
| 3,342,174 | 9/1967 | Tongue et al. | 126/96 |
| 3,367,318 | 2/1968 | Murakami et al. | 126/96 |

*Primary Examiner*—Samuel Scott

*Assistant Examiner*—Margaret A. Focarino

*Attorney, Agent, or Firm*—Brumbaugh, Graves, Donohue & Raymond

[57] ABSTRACT

A space heating apparatus includes a fuel tank and base assembly, a combustion chassis assembly supported on the base and supplied with combustion air for igniting and supporting a flame, and a top cover plate. The top cover plate includes a turret section providing a supporting surface for an upper cabinet assembly which is pivotally mounted on the turret. A mantle assembly is disposed in the cabinet to produce radiant heat and a portion extends down over the combustion chassis assembly. A slideable lower spill tray and an upper spill tray on the top cover plate provide ready access for detecting and cleaning kerosene spills, and for removing char and other debris.

4 Claims, 4 Drawing Figures

SPACE HEATING APPARATUS

BACKGROUND OF THE INVENTION

The present invention is a space heating apparatus for use in particular with a kerosene heated radiation heater.

Kerosene heaters are most commonly used as portable space heaters. While kerosene is especially suited as a heating fuel due to its low inflammability relative to volatile fuels such as gasoline, which makes it adaptable to be stored in the heater over extended periods of time and transportable, as well as its ready availability and low cost, special precautions must nevertheless be taken in kerosene heaters. For example, the combustion assembly of the heater must be able to provide the optimum burning flame not only for maximum heat generation, but also to produce only a minimum amount of smoke and other pollutants. Since the heater is intended to be portable, and often used outside, the device must be light and easy to transport, and provide a minimum danger from spilled kerosene igniting.

SUMMARY OF THE INVENTION

The present invention is an improved kerosene space heating apparatus which is highly efficient, lightweight and portable, and easy to maintain. More particularly, the space heater includes a fuel tank assembly, which also serves as the base for the heater, a combustion chassis assembly including a wick adjuster assembly, an automatic extinguisher assembly and an igniter assembly, and a mantle assembly, which components constitute the principal flame and heat producing components of the heater. A cabinet assembly, which is rotatably mounted relative to the functional heat producing parts of the heater through an interlocking rotary ring and fixed ring support mechanism, is adapted to be positioned in a number of selected horizontal pivotal positions relative to the base. The cabinet assembly pivots independently of the base components and thus radiant heat may be directed in any desired direction without the need to re-position the heater, thereby reducing the danger of spilling kerosene.

More particularly, the fuel tank and base assembly includes a fuel tank which may be provided with a fuel tank gauge and a fuel filler plug. The tank has a top central opening from which a wick-supporting cylinder extends upright. The cylinder is hollow to permit combustion air to enter up through the cylinder and permit char and other debris to fall down through the cylinder. A sliding bottom spill tray is positioned below the fuel tank under the bottom opening of the upright cylinder but is mounted to provide air vent openings to the upright cylinder to permit an updraft of air to feed the flame. Char and other debris which exit down through the hollow cylinder are collected in the spill tray. The spill tray slides in and out from the bottom of the fuel tank assembly for ease of cleaning.

A composite wick, cylindrical in shape, fits over the upright wick supporting cylinder and has its lower end immersed in the kerosene. A gasket or packing of rubber is normally provided between the wick and the top fuel tank opening to prevent the escape of kerosene fumes and reduce spillage. The upper end of the wick is received in the wick adjustment device of a combustion chassis assembly which includes an external knob so that the operator of the heater may adjust the height of the wick for optimum heat output and flame. An automatic ignitor assembly is also provided, which is connected with a battery mounted on the base, and which is actuated by an external switch. By pressing the switch, an ignitor coil of the ignitor assembly is moved into contact with the wick, and at the same time the battery current is connected across the ignitor coil to heat the coil and thereby light the wick. The combustion chassis assembly also includes an automatic extinguisher assembly which is positioned over the wick. The ignitor assembly is normally opened, but closes over the wick to extinguish the flame should the space heater accidentally tip on its side. This is a known safety device in kerosene space heaters. The entire combustion chassis assembly is positioned between the fuel tank-base and an upper cover plate.

The upper plate includes an upper drip tray which is formed integral with an upright turret. The upper drip tray provides a visible means of detecting kerosene spills which may have taken place in the upper portion of the assembly, and is also a collecting plate for char and other debris from the wick and the mantle assembly. Since serious kerosene spills are likely to reach the area of the upper drip tray, the provision of this feature is a marked advantage in providing safety of operation. In addition, in this arrangement the upper and lower drip trays collect essentially all spilled kerosene, char, and other debris which in other devices may collect in inaccessible areas of the heater. Kerosene spilled through the turret and onto the spill tray would be readily visible and easily cleaned up before any danger of ignition.

The turret has a central opening over the wick assembly that receives the mantle assembly (which carries the flame) described below. The upright turret wall is provided with openings for access to the wick adjustment device, the automatic ignitor assembly switch, the automatic extinguisher assembly lever (normally provided for manual actuation), and also access to the battery compartment of the automatic igniter. In addition, the turret provides the support base for the pivotable upper cabinet assembly.

The cabinet assembly includes a generally rectangular shaped cabinet with the forward face open for emitting radiant heat. The bottom plate of the cabinet includes an opening which cooperates with the central turret opening to receive the mantle assembly. An interlocking rotary ring and fixed ring supporting system is arranged between the top flat portion of the turret and the bottom plate of the cabinet assembly to permit the cabinet to rotate relative to the turret about the central axis of the mantle assembly-receiving openings in the cabinet lower plate and turret. A semi-circular reflector, for example formed of stainless steel, is positioned in the cabinet assembly equidistant from the central axis of the lower plate opening, to reflect radiant heat out through the open front of the cabinet. A protective steel grill is normally also provided on the opening front face of the cabinet.

The mantle assembly is arranged over the combustion chassis assembly and includes an outer glass chimney, a middle chimney, an inner chimney, and a cover disc thereover. The lower portion of the mantle assembly is received in the central opening of the turret and projects through the central opening in the bottom plate of the cabinet, and up into the cabinet assembly proper.

The mantle assembly is the flame carrying portion of the combustion producing components, and thus only the lower portion of the mantle is contained within the turret opening. The major portion of the upright mantle chimneys are disposed in the open cabinet space and substantially centrally located relative to the reflector, so that the radiation heat emitted by the flame in the mantle projects substantially entirely out of the front of the heater. At the same time, the cabinet assembly can be rotated relative to the turret, without affecting the mantle assembly or any of the other combustion related components (which remain stationary). Thus, the heater can be positioned over a range of relative angles without the necessity of repositioning the heater and the resulting danger of spilling kerosene and since the reflector pivots with the cabinet, heat will radiate at the selected angle. A detent assembly between the turret and upper cabinet cooperates with the mating ring arrangement for locking the upper cabinet in one of a plurality of angular positions. The detent arrangement includes a spring held latch which engages one of a plurality of cooperating slots to hold the cabinet in the seleced position.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
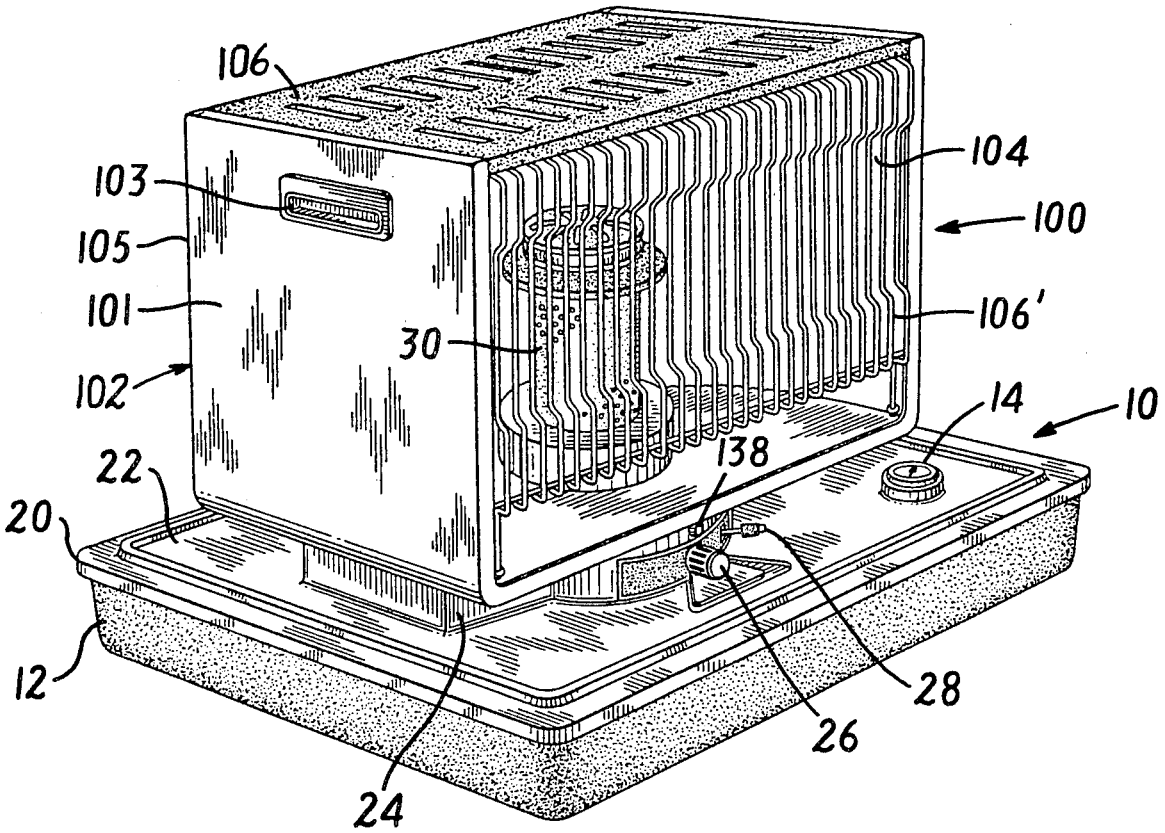
FIG. 1 is a perspective pictorial view of a space heating apparatus in accordance with the invention.

Referring to FIG. 1, a kerosene space heating apparatus includes a lower base assembly 10 having a fuel tank and combustion related components, and an upper cabinet assembly 100 which is pivotally mounted relative to the lower base assembly 10. More particularly, the base 10 includes a fuel tank and chassis mounting assembly 12, and an upper cover plate 20. The base 10 supports a mantle assembly 30 and a turret section 24 which is the base for the cabinet assembly 100. The upper plate 20 includes an upper spill tray 22. The turret section provides access for a wick adjustment knob 26 and an ignition lever 28, while the upper fuel tray 22 provides an opening for a fuel gauge 14 and fuel filler cap 16 (See FIG. 2).

The upper cabinet assembly 100 includes a cabinet 102, having a pair of carrying handles 103 (one shown), an internally arranged heat reflector 104 (FIG. 2), and a front protective grill 106.

Figure 2:
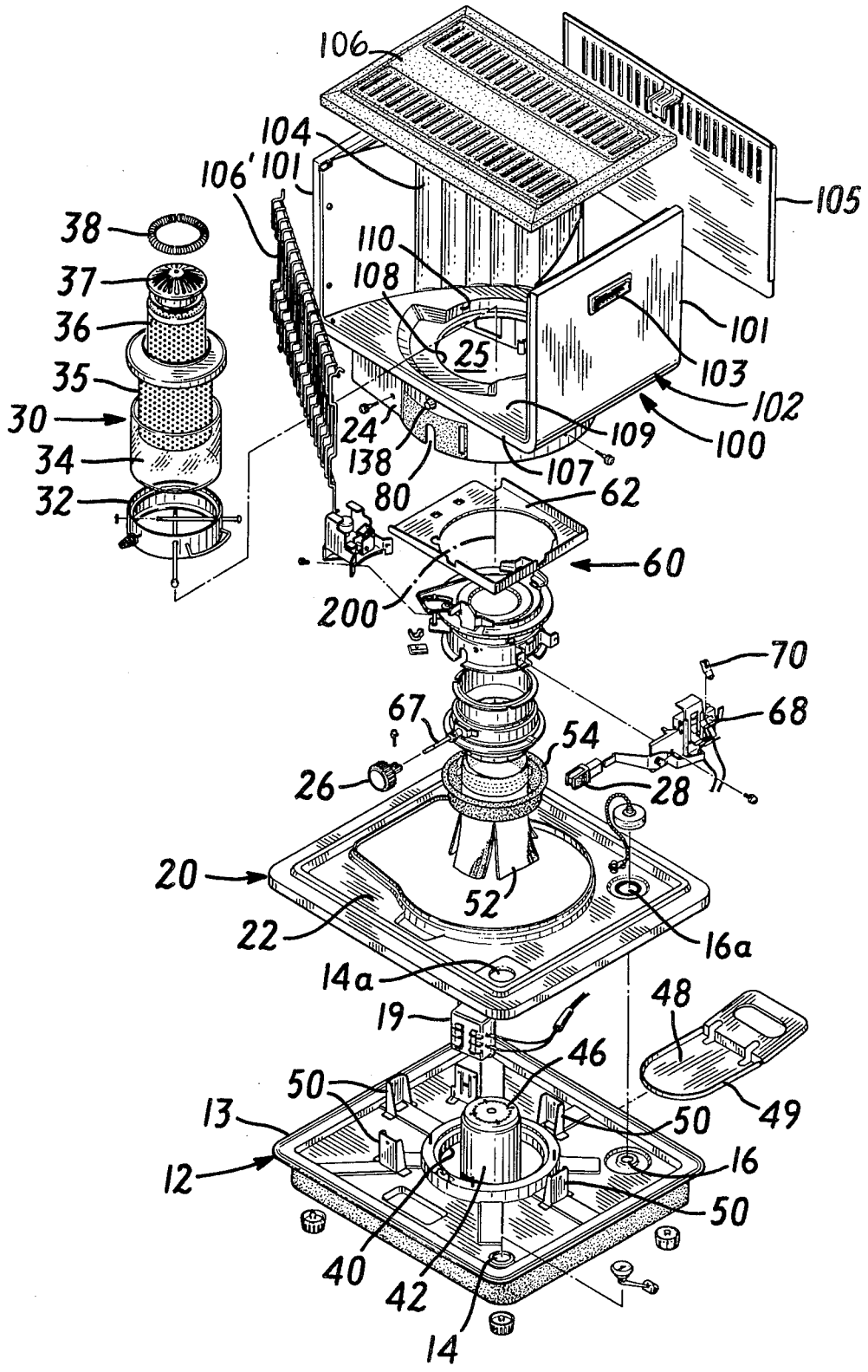
FIG. 2 is an exploded perspective view of the functional components of the heater assembly.

Referring to FIG. 2, the fuel tank and mounting assembly 12 includes the fuel tank 13 with a central opening 40 and an upright hollow wick-supporting cylinder 42 projecting therefrom. The hollow cylinder 42 provides primary combustion air and also allows char and other debris from the wick to escape through the cylinder.

A sliding bottom spill tray 48 slides into position below the fuel tank and mounting assembly 12 under the cylindrical opening of the wick-supporting cylinder 42 to catch any char or debris which enter the openings 46 in the top of the cylinder 42. As shown in FIG. 2, the spill tray 48 includes side flanges 49 which may be received in a cooperating tray support structure which is attached to the bottom of the fuel tank by tabs. The tray support structure has an inwardly extending lip which supports the side flanges 49 of the spill tray 48. The chassis mounting assembly 12 also includes a number of upright supporting resilient steel bracket guide posts 50 which are welded to the top of the mounting assembly for receiving and holding the upper cover plate 20, as described further on. The mounting assembly 12 also supports a battery compartment 19.

Referring still to FIG. 2, a composite cylindrical wick 52, with, for example, a glass fiber top and cotton or cotton blend tails, slides over the upright cylindrical post 42. A portion of the wick 52 extends upward from the post 42, and the lower portion of the wick 52 is disposed in the fuel tank immersed in the kerosene liquid. A gasket or packing of rubber 54 is arranged between the mating flanges of the top of the mounting assembly 12 and a combustion chassis assembly 60. Its inner edge extends to the wick to form a secondary seal to reduce kerosene spillage.

The combustion chassis assembly 60 surrounds the wick and is provided for controlling the flame. The combustion chassis assembly includes a wick adjuster assembly and automatic extinguisher assembly. The wick adjuster assembly is controlled by a control stem 67 and the rotating knob 26 which projects outside of the turret 24, to provide for the raising and lowering of the wick 52. An automatic igniter assembly 68 is mounted to the combustion chassis assembly 60 such that when the actuating lever 28 is depressed, the heater element or igniter coil 70 moves into contact with the wick 52. The automatic igniter assembly 68 is connected with the one or more batteries contained in compartment 19. By pressing the lever, the battery terminals are connected across the igniter coil 70, which at the same time being pressed into contact with the wick, ignites the flame. The automatic igniter assembly and extinguisher assembly are known and will therefore not be described in greater detail. The combustion chassis assembly is also provided with a radiation shield 62.

The upper cover 20 fits over the combustion chassis assembly 60. The turret section 24 covers the combustion chassis and the opening in the upper cover. The upper cover is fastened flush with the chassis mounting assembly 12 by thumb screws which engage the steel brackets 50. When mounted, openings **14*a* and 16*a* are aligned with the fuel gauge and filler cap openings 14 and 16, respectively. The stem 67 of the combustion chassis assembly, for regulating the wick height, is received through a slotted opening 80 in the turret 24. A second opening 82 in the turret receives the stem of a detent latch 110 which is usually incorporated within the turret during its assembly. The spill tray 22** collects any spilled kerosene, char, or any other debris, and permits easy access for cleaning.

The mantle assembly 30 includes a chimney supporter 32, an outer glass chimney 34, a middle chimney 35, and an inner chimney 36. A top chimney disc arrangement 37 and heating coil 38 are arranged over the chimneys. The mantle assembly 30 is received in the central opening 25 of the turret 24 and is positioned over the combustion chassis assembly 60. Thus, fuel ignited in the wick 52 is substantially burned in the chimney arrangement of the mantle assembly 30.

Figure 3:
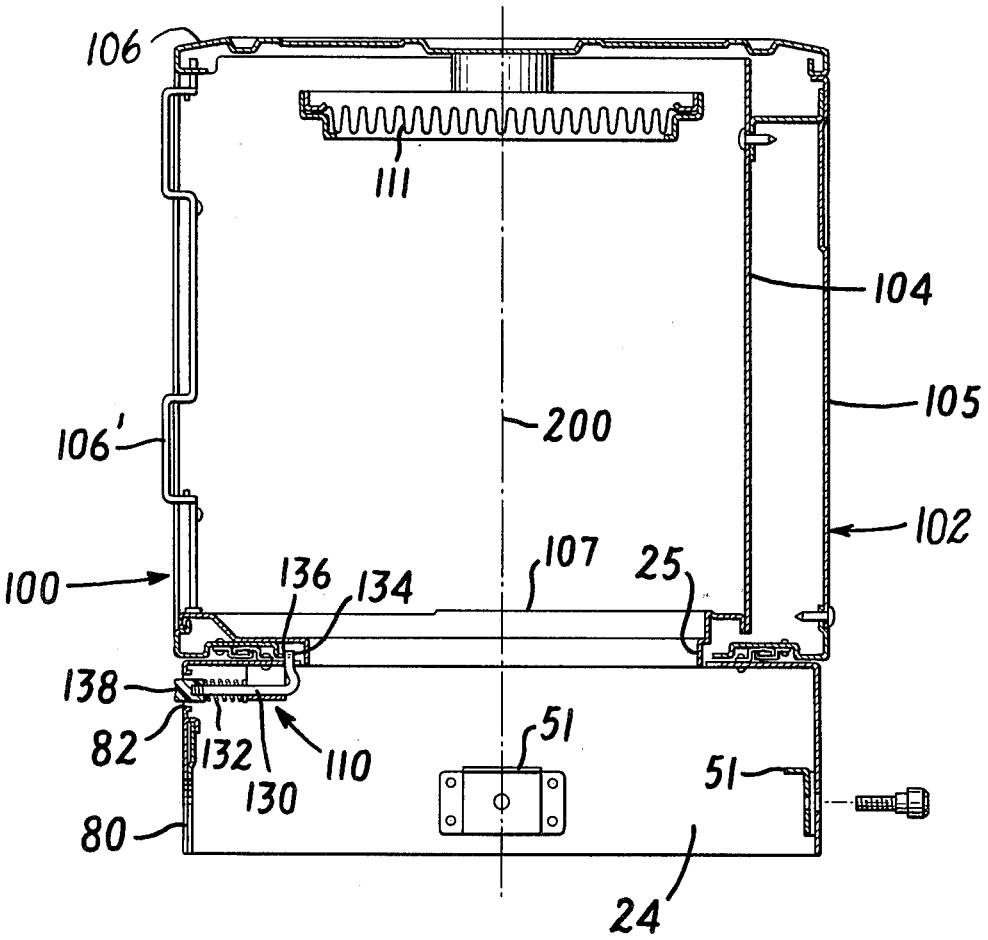
FIG. 3 is a side-sectional view of the turret and upper cabinet assembly, illustrating a mating ring arrangement in accordance with the invention.

The upper cabinet assembly 100 includes a cabinet having sidewalls 101, a backwall 105, a top plate 106 with openings to permit heat to escape, and a bottom plate 107. The bottom plate 107 includes a central opening 108 designed to cooperate with the central opening 25 of the upper cover 20. A hemicylindrical reflector plate with a non-circular curvature 104 is positioned in the cabinet assembly 100 such that its open side faces outward. Preferably, the reflector 104 is formed of stainless steel. The reflector 104 is supported on a bottom plate 109 having a central opening 110 cooperating with the central opening 108 of the bottom plate 107 of the upper cabinet assembly. A catalytic device 111 (FIG. 3) may also be provided to reduce hydrocarbon and carbon monoxide emissions.

Figure 4:
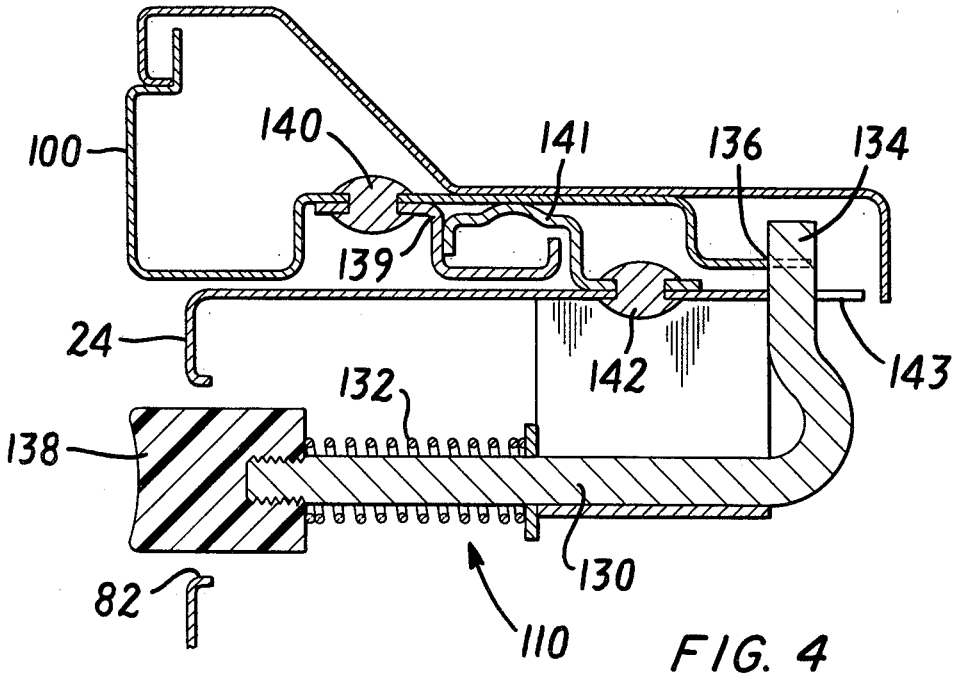
FIG. 4 is a side-sectional view of the mating ring arrangement of FIG. 3 on an enlarged scale.

The top cabinet assembly 100 attaches to the lower stationary components by means of pivotable mounting arrangement. One form of pivotable mounting is illustrated in FIG. 4, in which a rotary ring 139, concentric with the central axis 200 of the openings 108, 25 is attached with rivets 140 to the bottom of the cabinet assembly 100. A fixed ring 141 is attached with a rivet 142 to the turret section 24. The rotary ring interlocks with the fixed ring to form a mating ring arrangment which supports the cabinet assembly on the turret and provides relative ease of pivoting. Other arrangments, however, such as a ball bearing track may be provided.

In order to lock the top cabinet 100 in a desired position, a detent arrangement is provided. The detent includes a spring loaded latch 110 (See FIGS. 2, 3 and 4) which is urged outward by spring 132 and which is fixed relative to the turret 24. The latch 110 extends through the opening 82 in the turret and has an upwardly extending tip 134 in the central opening 25 of the turret 24. The tip 134 of the latch 130 is guided by the top plate of the turret 143 so that it engages one of a plurality of cooperating slots 136 cut in the inner face of the central opening 108 of the bottom plate 107 of the chassis assembly 100. The slot 136 which is centrally positioned on the bottom plate 107 is deeper than the slots which are positioned on either side of it. As a result, this centrally positioned slot provides a positive lock whereas the other slots are shallow and provide detents but not positive locks.

A release knob 138 is attached to the outer portion of the latch 110 extending from the turret 24. Thus, when the release knob 138 is pressed inwardly, the tip 134 moves out of engagement with the slot 136, and releases the upper chassis 100 to be pivotable about axis 200. Since only the centrally positioned slot provides a positive lock, it is the only position which requires the pressing of the knob 138 for release.

When the knob 138 is released, the spring urges the tip 134 against the wall of the opening 25, and when the tip 134 moves into cooperating relation with an adjacent slot, the chassis is again held in position.

The invention has been shown with reference to a preferred embodiment thereof. Variations and modifications of the invention will be apparent to persons skilled in the art without departing from the inventive concepts disclosed herein. All such modifications and variations are intended to be within the scope of the present invention as defined in the following claims.

I claim:

1. A space heating apparatus for use in particular with kerosene fuel, comprising:

(a) fuel tank and base assembly, said fuel tank having a top opening and an upright wick-supporting cylinder extending from said opening, wherein said cylinder is hollow for permitting the passage of combustion air from below said tank up through said cylinder and for permitting char and other debris to exit said apparatus;

(b) a lower spill tray;

(c) means for mounting said lower spill tray to the underside of said fuel tank and base assembly to be positioned below said upright cylinder for collecting char and other debris and to permit combustion air to enter said hollow cylinder;

(d) a combustion chassis assembly supported on said base assembly over said upright cylinder and including a wick positioned on said cylinder and partially disposed in said fuel tank, a wick height adjusting mechanism and an automatic igniter mechanism for igniting and supporting a flame;

(e) a top cover plate arranged to fit over said combustion chassis assembly on said fuel tank and base assembly and having a turret section with a first central opening over said combustion chassis assembly for receiving a mantle assembly and an upper support surface, and said plate including an upper spill tray for collecting char and spilled kerosene;

(f) a cabinet assembly supported on said turret section and having a bottom plate with a second central opening cooperating with said first central opening of said turret section;

(g) means for pivotally mounting said cabinet assembly to said top cover plate on the upper support surface of said turret section; and (h) a mantle assembly positioned over said combustion chassis assembly and partially disposed in said first and second openings to communicate with said combustion chassis assembly for receiving said flame.

2. Apparatus according to claim 1 comprising detent means arranged between said turret and said cabinet assembly for holding said cabinet assembly in a selected one of a plurality of angular positions.

3. Apparatus according to claim 2, comprising means for slideably mounting said bottom spill tray to the underside of said fuel tank assembly.

4. Apparatus according to claim 3, comprising reflector means arranged in said cabinet assembly for rotation therewith independent of said top cover plate and said mantle, wherein radiant heat may be directed in a selected angular direction.

* * * * *

UNITED STATES PATENT AND TRADEMARK OFFICE

CERTIFICATE OF CORRECTION

PATENT NO. : 4,357,929

DATED : November 9, 1982

INVENTOR(S) : Edward J. Johnson

It is certified that error appears in the above—identified patent and that said Letters Patent is hereby corrected as shown below:

On the title page, Item 56, add:
906,964 Great Britain 9-26-62

Title page, Col. 3, line 52, after "and" insert --a--; Col. 6, line 25, "igniter" should read --ignition--; line 39, "pivotally" should read --rotationally--; line 41, after "section" insert --, wherein said cabinet assembly is mounted for horizontal rotation--; line 50, before "angular" insert --horizontal--; and line 58, before "angular" insert --horizontal--.

Signed and Sealed this

*Nineteenth* Day of *April 1983*

[SEAL]

*Attest:*

GERALD J. MOSSINGHOFF

*Attesting Officer*

*Commissioner of Patents and Trademarks*